US011541558B2

(12) United States Patent
Evans

(10) Patent No.: US 11,541,558 B2
(45) Date of Patent: Jan. 3, 2023

(54) TACTICAL KNIFE

(71) Applicant: Scott V. Evans, Jacksonville, NC (US)

(72) Inventor: Scott V. Evans, Jacksonville, NC (US)

( * ) Notice: Subject to any disclaimer, the term of this patent is extended or adjusted under 35 U.S.C. 154(b) by 244 days.

(21) Appl. No.: 16/936,162

(22) Filed: Jul. 22, 2020

(65) Prior Publication Data

US 2021/0023726 A1 Jan. 28, 2021

Related U.S. Application Data

(60) Provisional application No. 62/876,812, filed on Jul. 22, 2019.

(51) Int. Cl.
*B26B 3/00* (2006.01)
*B26B 9/02* (2006.01)

(52) U.S. Cl.
CPC . *B26B 3/00* (2013.01); *B26B 9/02* (2013.01)

(58) Field of Classification Search
None
See application file for complete search history.

(56) References Cited

U.S. PATENT DOCUMENTS 3,538,605 A * 11/1970 Smith ..... B26B 29/02 30/295
6,842,986 B2 * 1/2005 Holler ..... B26B 29/02 30/314
9,358,694 B1 * 6/2016 Heumann ..... B26B 29/02
2003/0208910 A1 * 11/2003 Dudley, Jr. ..... B26B 3/00 30/142
2010/0101100 A1 * 4/2010 Hansen ..... B26B 3/00 30/357
2021/0023726 A1 * 1/2021 Evans ..... B26B 9/00
2021/0283790 A1 * 9/2021 Cohen ..... B26B 9/02

OTHER PUBLICATIONS thefirearmblog.com/blog/2018/10/29/history-evolution-soviet-russian-ak-bayonets/, "Histroy and Evolution of Soviet/Russian AK Bayonets", AK bayonet model 6X3 manufactured by Tula Arms Plant, years 1960-1964.*

* cited by examiner

*Primary Examiner* — Hwei-Siu C Payer
(74) *Attorney, Agent, or Firm* — Stephen M. Kepper; Intellectual Property Consulting, LLC

(57) ABSTRACT

The knife includes a handle portion attached to a blade with a tip at its distal end. The blade comprises four surfaces that converge to form a spine and opposing cutting edges with each surface having a concave segment, a first angled segment, a flat segment, and a second angled segment as the surface extends from the spine to the edge. Similarly, the tip includes four surfaces that converge and terminate at a point, with each surface comprising only an angled segment. Optionally, the knife includes a unique safety lanyard that has two attachment points on the handle such that a closed loop is adjustably formed around the user's hand when gripping the handle, which aids in withdrawing the knife, stabilizing the user's grip, and preventing the hand from sliding forward while in use. Optionally, the knife includes a thumb plate as an additional safeguard.

10 Claims, 9 Drawing Sheets

TACTICAL KNIFE

RELATED APPLICATIONS

This application claims priority to U.S. Provisional Application No. 62/876,812 filed Jul. 22, 2019. The entire contents of the above application are hereby incorporated by reference as though fully set forth herein.

FIELD

The present invention relates generally to a knife. More specifically, the present invention relates to a portable tactical knife with additional safety features and a blade configuration operable to increase blade strength, sharpness, durability, and longevity in maintaining an optimal cutting edge.

BACKGROUND

When it comes to knife blade configurations, there are several types of grinds known in the prior art. For example, a traditional hollow grind is concave such that the two planar sides curve inward until they meet at their terminal edge. Conversely, a convex grind has the two planar sides curve outward until they meet at their terminal edge. Other grinds include a straight grind that is beveled at a consistent angle from the centerline to the cutting edge. Each of these grinds has their own strengths and weaknesses. For example, a straight (or angled) grind on all four planar surfaces, resulting in a diamond-like cross section, provides a strong spine but sacrifices sharpness. Conversely, the hollow, concave grind results in a very sharp edge, but this edge is a more fragile and is prone to breaking or wear during use. Additionally, for each of these and other cutting edges, the performance and useful life of the blade decreases with each act of sharpening. With each sharpening, the material left behind the edge gradually thickens forcing the angle to become more obtuse, thus decreasing the sharpness and performance of the knife.

Accordingly, there is a need for a knife blade of superior sharpness that can continue to be sharpened without sacrificing the structural integrity of the blade.

Additionally, knives are generally used to puncture an object by forcefully pushing the knife blade forward into the object. When this force is applied, the hand of the user is susceptible to sliding forward beyond the handle of the knife and onto the blade, resulting in injury as well as loss of control of the knife. In order to prevent the hand from sliding forward, the prior art discloses a variety of lanyards that attach at the base of the knife; the preexisting lanyards wrap around the user's wrist and when the knife punctures the object, the lanyard is designed to restrict the forward motion of the user's hand. However, since these lanyards only grip the user's wrist, as opposed to the user's hand, it is not very efficient in preventing the hand from unexpectedly sliding forward while in use.

Accordingly, there is a need for a safety mechanism that secures the hand of the user to the knife handle and prevents hand slippage when the knife is in use.

BRIEF SUMMARY OF THE INVENTION

It is the object of the present invention to provide a tactical knife with a blade configuration designed to outperform existing knife blades.

It is another object of this invention to provide a safety lanyard with an optional safety thumb plate to assist in securing the user's hand to the knife handle while in use.

The preferred embodiment of the subject knife includes a handle portion attached to a blade with a tip at its distal end. The blade comprises four surfaces that converge to form a spine and opposing cutting edges with each surface having a concave segment, a first angled segment, a flat segment, and a second angled segment as the surface extends from the spine to the edge. Similarly, the tip includes four surfaces that converge and terminate at a point, with each surface having only an angled segment In yet another embodiment, the knife includes a lanyard that has two attachment points; the first attachment point is near the proximal end of the handle portion and the second attachment point at or near the distal end of the handle portion where it meets the blade. The dual attachment points of the lanyard creates a closed loop around the user's hand when gripping the handle, which aids in withdrawing the knife, stabilizing the user's grip, and preventing the hand from sliding forward while in use.

In yet another embodiment, the knife includes a thumb plate attached to the distal end of the handle portion, wherein the thumb plate is configured to prevent the thumb from sliding forward onto the blade. As an additional option, the thumb plate is operable to serve as a second attachment point for the safety lanyard. Additionally, the thumb plate may also limit or prevent over penetration of the blade into an object that is being pierced.

DETAILED DESCRIPTION

Figure 1:
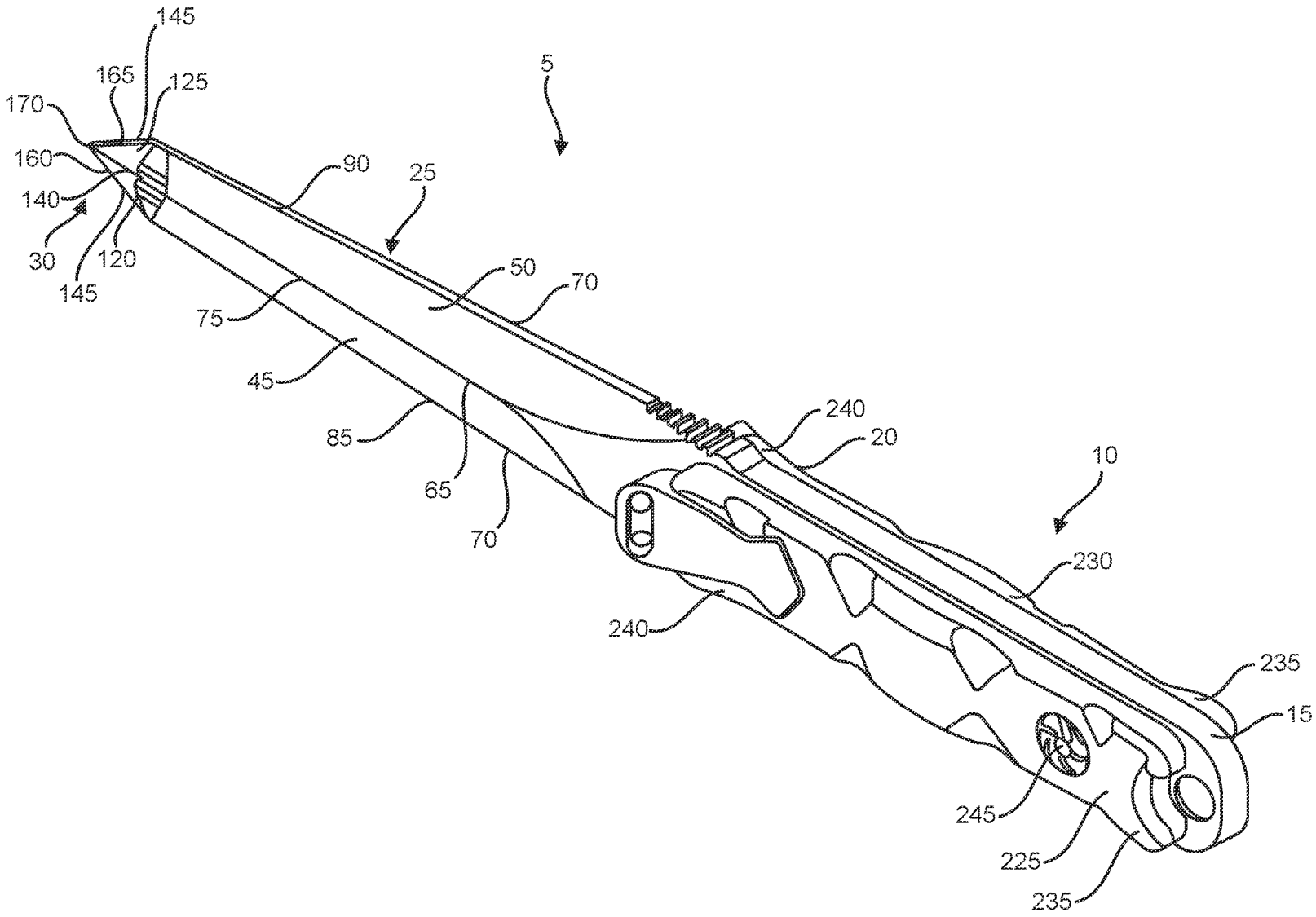
FIG. 1 is a perspective view of the knife.
Figure 2:
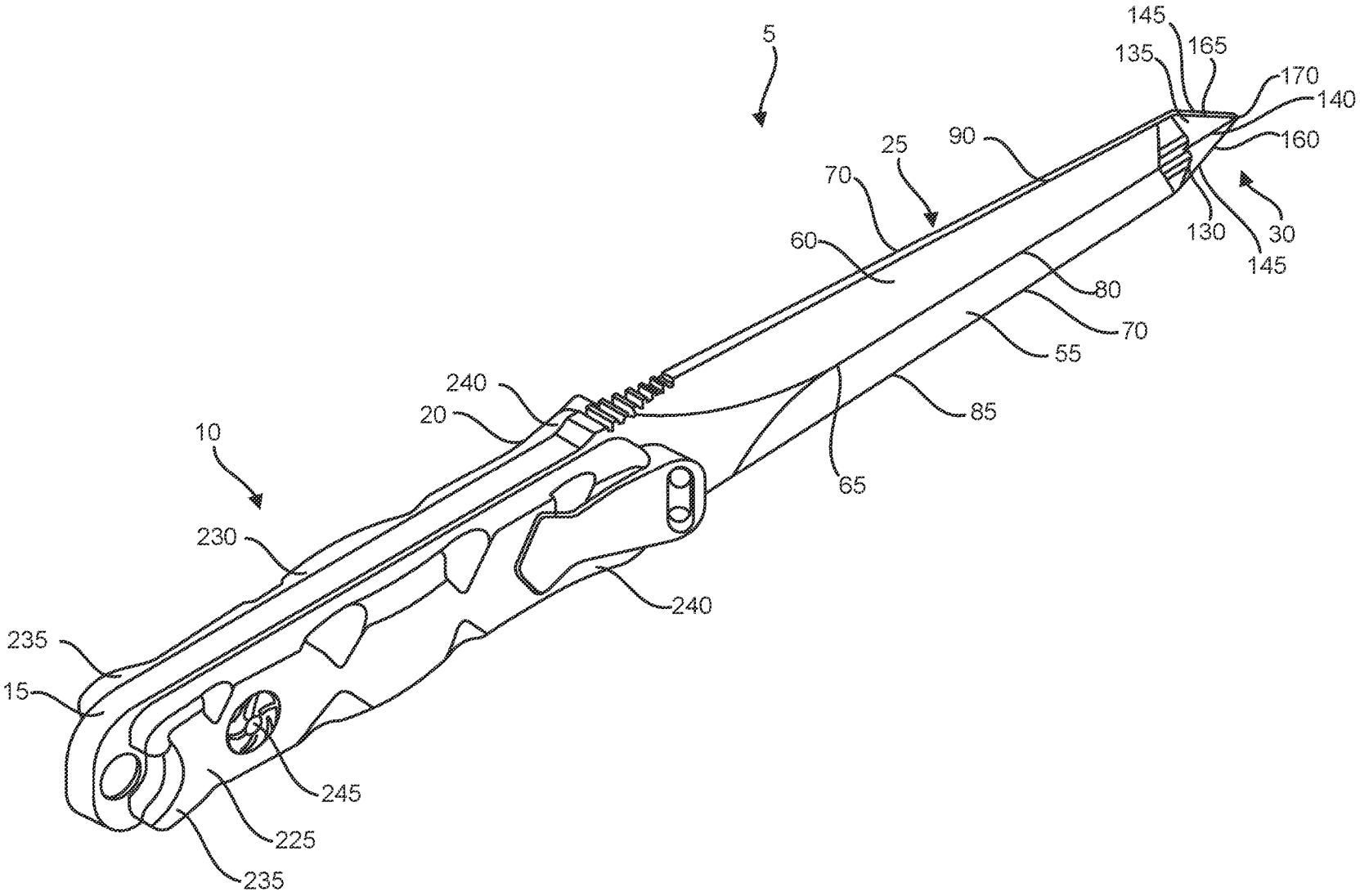
FIG. 2 is another perspective view of the knife.

Turning to FIGS. 1-2, alternative perspective views of the subject knife 5 are shown. The knife 5 comprises a handle portion 10 having a proximal end 15 and a distal end 20 with a blade 25 attached to the distal end 20 of the handle portion 10. The distal end of the blade includes a tip 30. The handle portion 10 may be molded as a solid contiguous piece or may be made of component parts that are fastened together.

Figure 3:
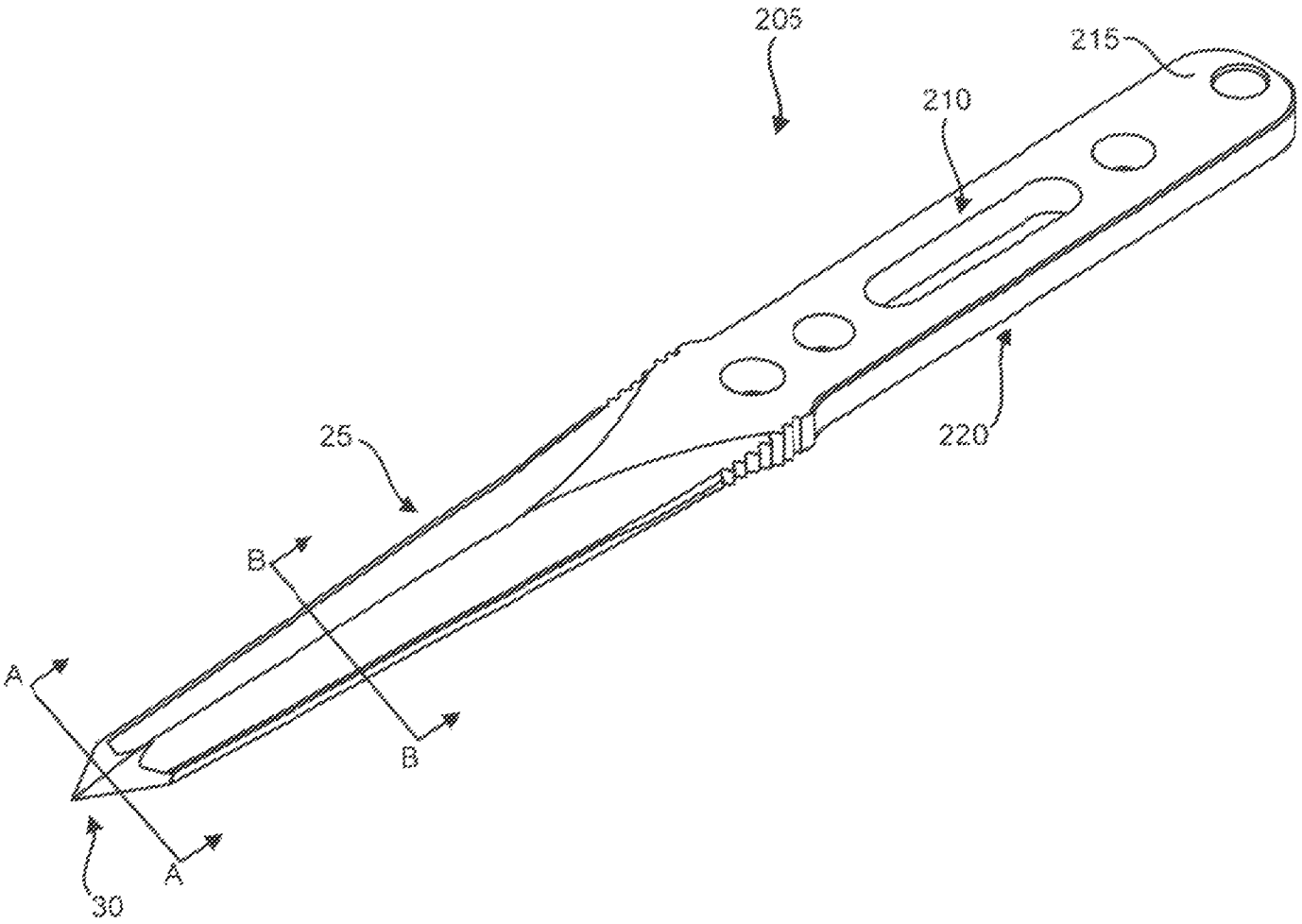
FIG. 3 is a perspective view of the elongate blade member.

Turning to FIG. 3, an elongate blade member 205 is shown having a base 210 with a top side 215 and bottom side 220 that form an integrated unitary body with the blade 25 and tip 30. For this embodiment, and as shown in detail in FIGS. 1-2, a first handle piece 225 and a second handle piece 230, each having a proximal end 235 and a distal end 240, are removably attached to the sides 215, 220 of the base 210 to form the handle portion 10. The handle pieces 225, 230 are secured to the base 210 of the elongate blade member 205 through a fastener 245, such as a nut and bolt, screws, pin or rivet, which may be located at one or more locations along the handle portion 10. The removability of the handle pieces 225, 230 from the base 210 of the elongate blade member 205 allows the user to replace damaged component parts without having to replace the entire knife.

Figure 5:
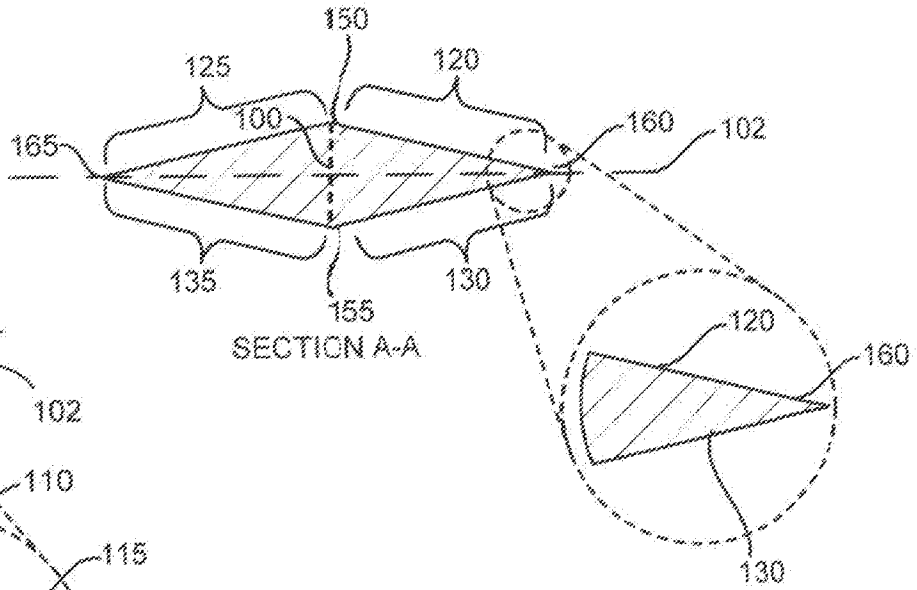
FIG. 5 is a cross-section view of the tip of the knife
Figure 4:
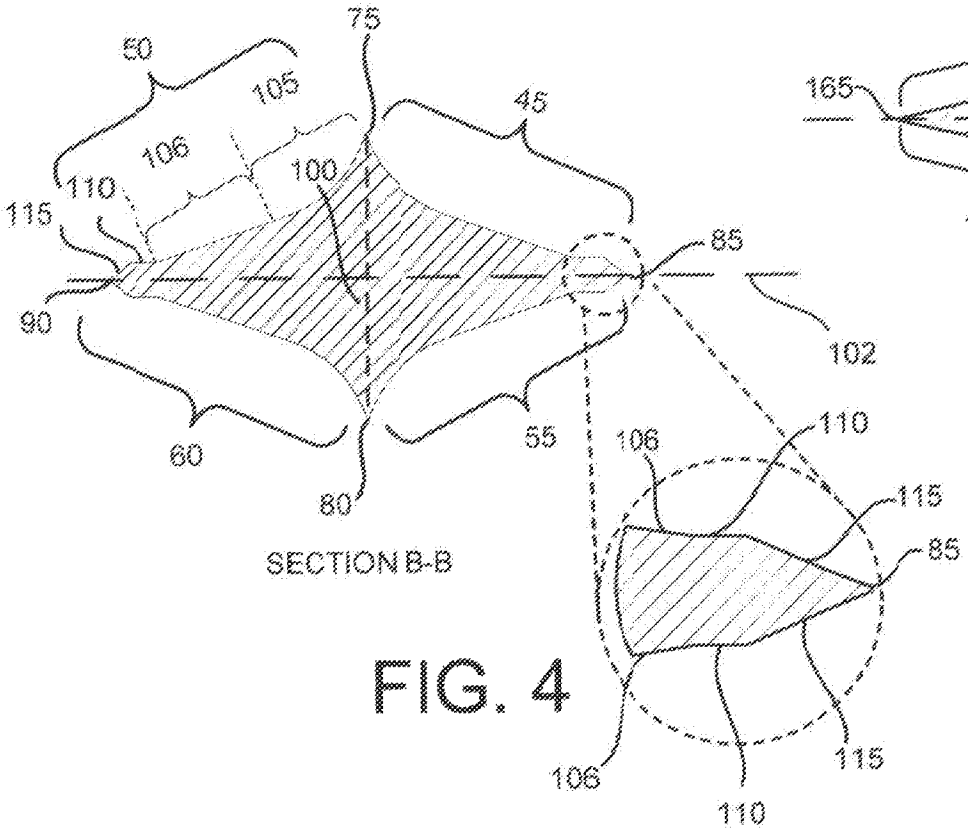
FIG. 4 is a cross section view of the blade of the knife.

Turning to FIGS. 4-5, cross-sectional views of the blade configurations for the blade 25 (Section B-B) and the tip 30 (Section A-A), as depicted in FIG. 3, are shown. For purposes of this disclosure, these cross-sectional views apply to the embodiments of the knife shown in FIGS. 1-2.

As shown in FIG. 4, the blade 25 is defined by the convergence of four independent surfaces: a first top surface 45, a second top surface 50, a first bottom surface 55, and a second bottom surface 60, with each surface having a first surface side 65 and a second surface side 70 (as shown in FIGS. 1-2). The first surface side 65 of the first top surface 45 and the second top surface 50 intersect at a top spine joint 75. The first surface side 65 of the first bottom surface 55 and the second bottom surface 60 intersect at a bottom spine joint 80. The second surface side 70 of the first top surface 45 and the first bottom surface 55 intersect at a first cutting edge 85. The second surface side 70 of the second top surface 50 and the second bottom surface 60 intersect at a second cutting edge 90. The spine of the blade 25 is defined by the vertical plane 100 between the top spine joint 75 and bottom spine joint 80.

Figure 10:
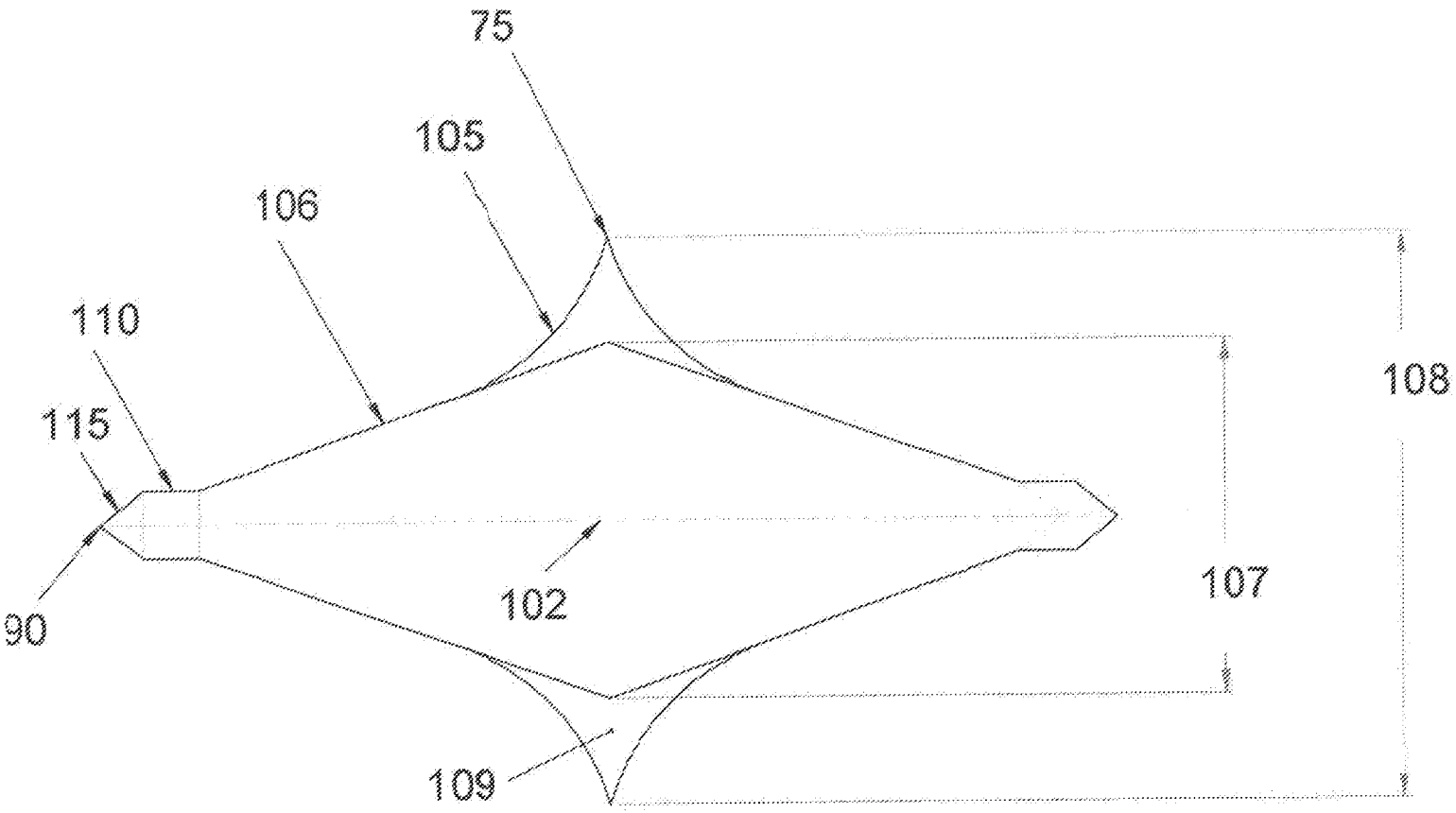
FIG. 10 is an alternative cross-section view of the blade of the knife showing a comparison of the preferred embodiment of the blade containing a concave segment proximal to the spine to a blade with an angled segment proximal to the spine.

Each of the four surface 45, 50, 55, 60 of the blade 25 is further defined by four segments: a concave segment 105 that is proximal to the spine, followed by a first angled segment 106 beveled at a consistent angle to the horizontal center line 102, followed by a flat segment 110 that is parallel to the horizontal centerline 102 of the blade, and a second angled segment 115 that is beveled at a consistent angle to the horizontal center line 102 and terminates at the cutting edge 85, 90. This arrangement allows for a sharp edge of the blade while not sacrificing valuable material needed for a stronger knife. Overall strength in the blade is increased by the creation of the spine. By extending the concave segment 105 tangent from the first angled segment 106 to the spine, additional mass is introduced reinforcing the overall strength of the blade. As shown in FIG. 10, a similar cross-section of the blade 25 is shown comparing a first blade configuration 107 without a concave segment 105 proximal to the spine to a second blade configuration 108 like the preferred embodiment having a concave segment 105. This figure demonstrates that the addition of the concave segment 105 adds additional mass 109 to the spine and increases the overall strength of the knife 5.

Turning to FIG. 5, the cross-section of the tip 30 of the blade 25 is shown. For purposes of this invention, the tip 30 and the blade 25 form a contiguous unitary body. Like the blade 25, the tip 30 also is defined by the convergence of four independent surfaces: a first top surface 120, a second top surface 125, a first bottom surface 130, and a second bottom surface 135, with each surface having a first surface side 140 and a second surface side 145 (as shown in FIGS. 1-2).

The first surface side 140 of the first top surface 120 and the second top surface 125 intersect at as a second top spine joint 150. The first surface side 140 of the first bottom surface 130 and the second bottom surface 135 intersect at a second bottom spine joint 155. The second surface side 145 of the first top surface 120 and the first bottom surface 130 intersect at a first cutting edge 160. The second surface side 145 of the second top surface 125 and the second bottom surface 135 intersect at a second cutting edge 165. Each of the four surfaces 120, 125, 130, and 135 of the tip 30, the spine joints 150, 155 and the cutting edges 160, 165 converge and terminate at a knife point 170 (as shown in FIGS. 1-2). Moreover, each of the four surfaces 120, 125, 130, and 135 are beveled at a consistent angle to the horizontal center line 102 of the tip 30 as the surface extends from the spine joint 150, 155 to the cutting edge 160, 165.

Figure 6:
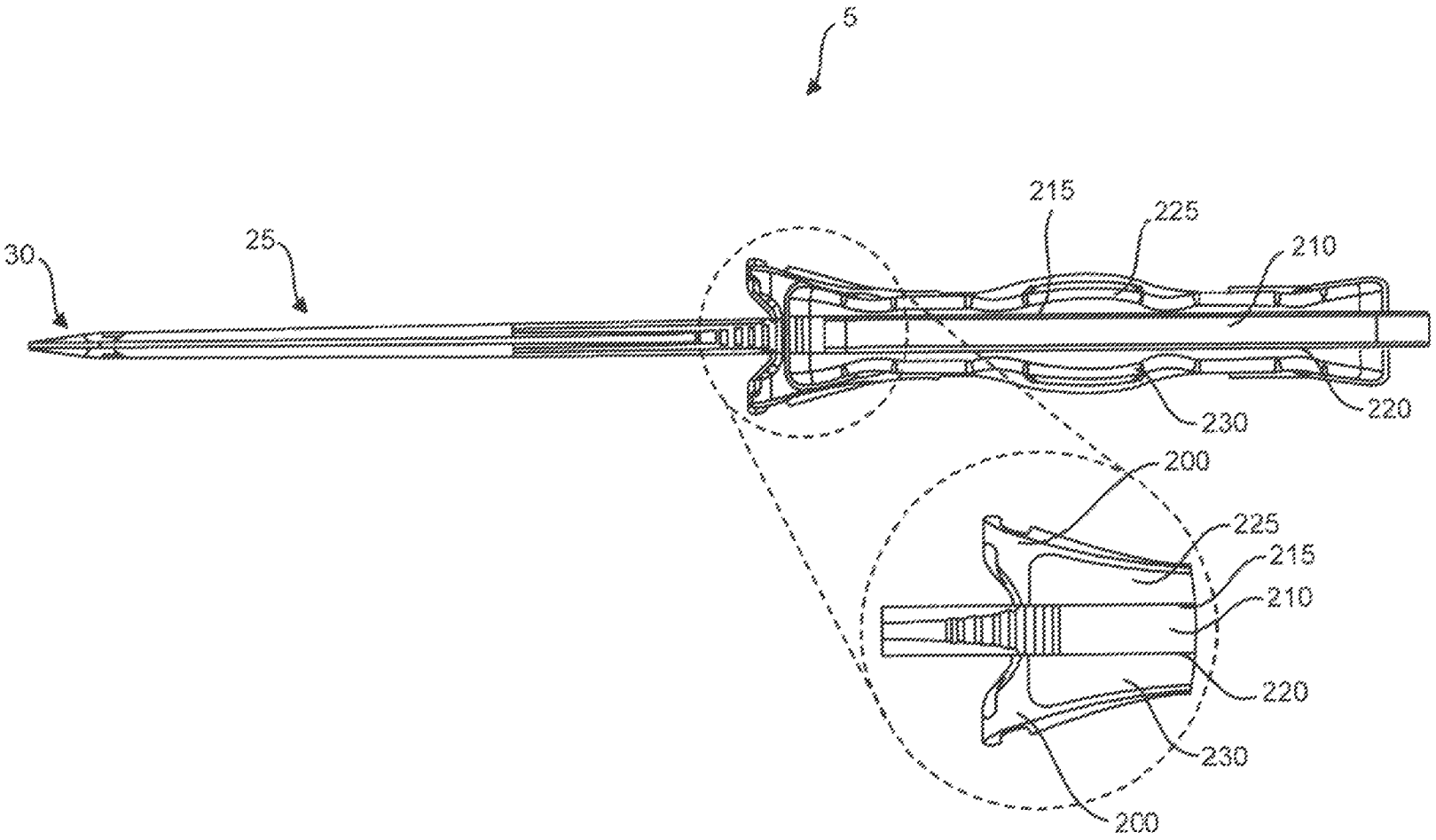
FIG. 6 is a side view of the knife showing the thumb plate.
Figure 7:
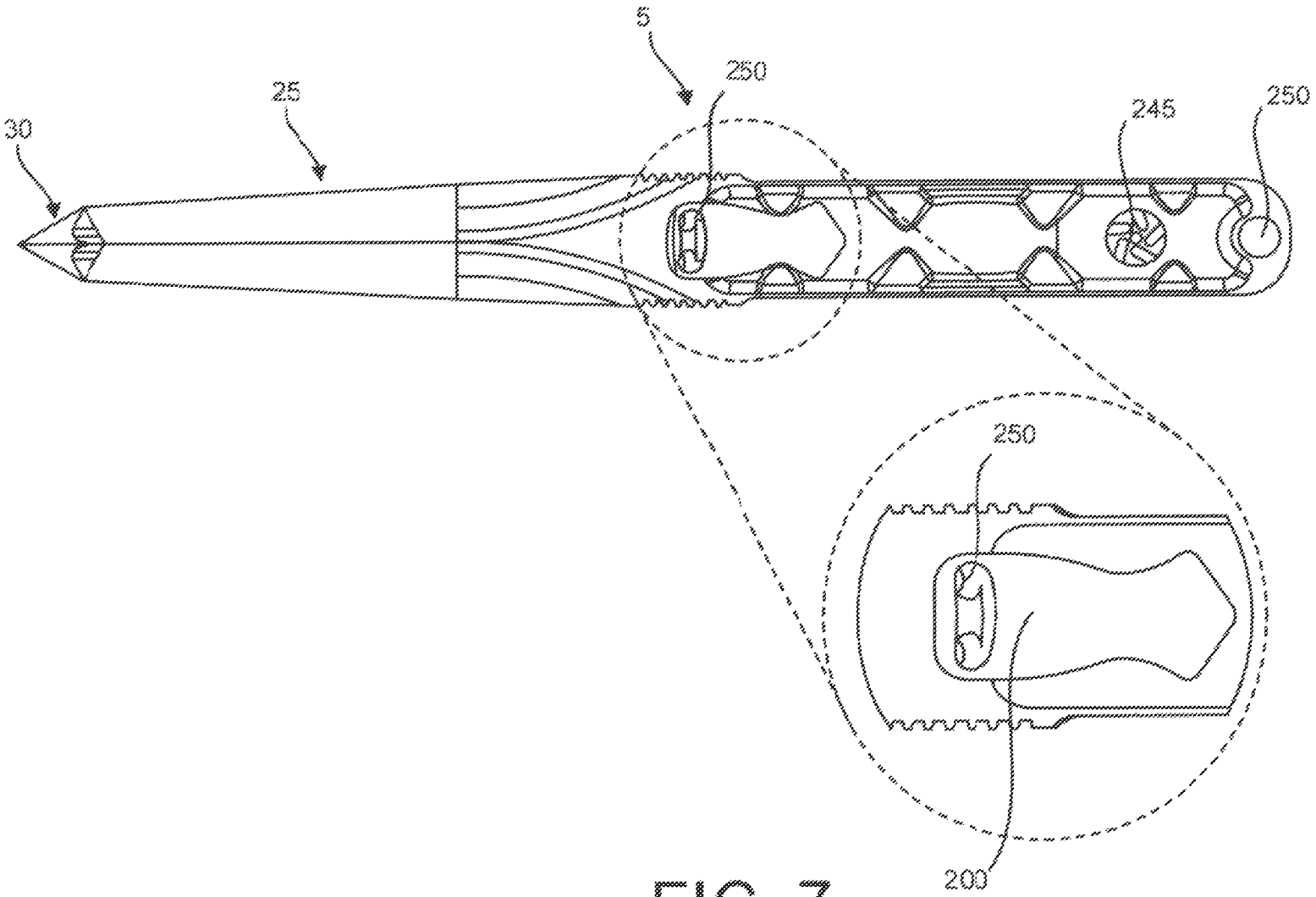
FIG. 7 is a top view of the knife showing the thumb plate.

Turning to FIGS. 6-9, alternative embodiments of the knife 5 are shown that include a safety lanyard 175 and optional thumb plate 200. As shown in FIGS. 6-7, the thumb plate 200 is positioned at the distal end 20 of the handle portion 10 and may be pre-molded to the handle portion 10 or either of the handle pieces 225, 230 such that it forms a unitary piece. Alternatively, the thumb plate 200 may be attached to the handle portion 10 using fastening means known in the art, including adhesives, welding, molding or fasteners, such as a nuts and bolts, screws, pins or rivets. The thumb plate 200 is configured such that it has a sloping wedge that angles upward towards the blade 25 and away from the knife handle portion 10. The size and shape of the thumb plate 200 provides a comfortable landing point for the user's thumb while using the knife 5 as well as serves as a partial barrier to keep the user's hand from sliding forward onto the blade 25 while in use. Additionally, the thumb plate may also limit or prevent over penetration of the blade into an object that is being pierced.

Figure 8:
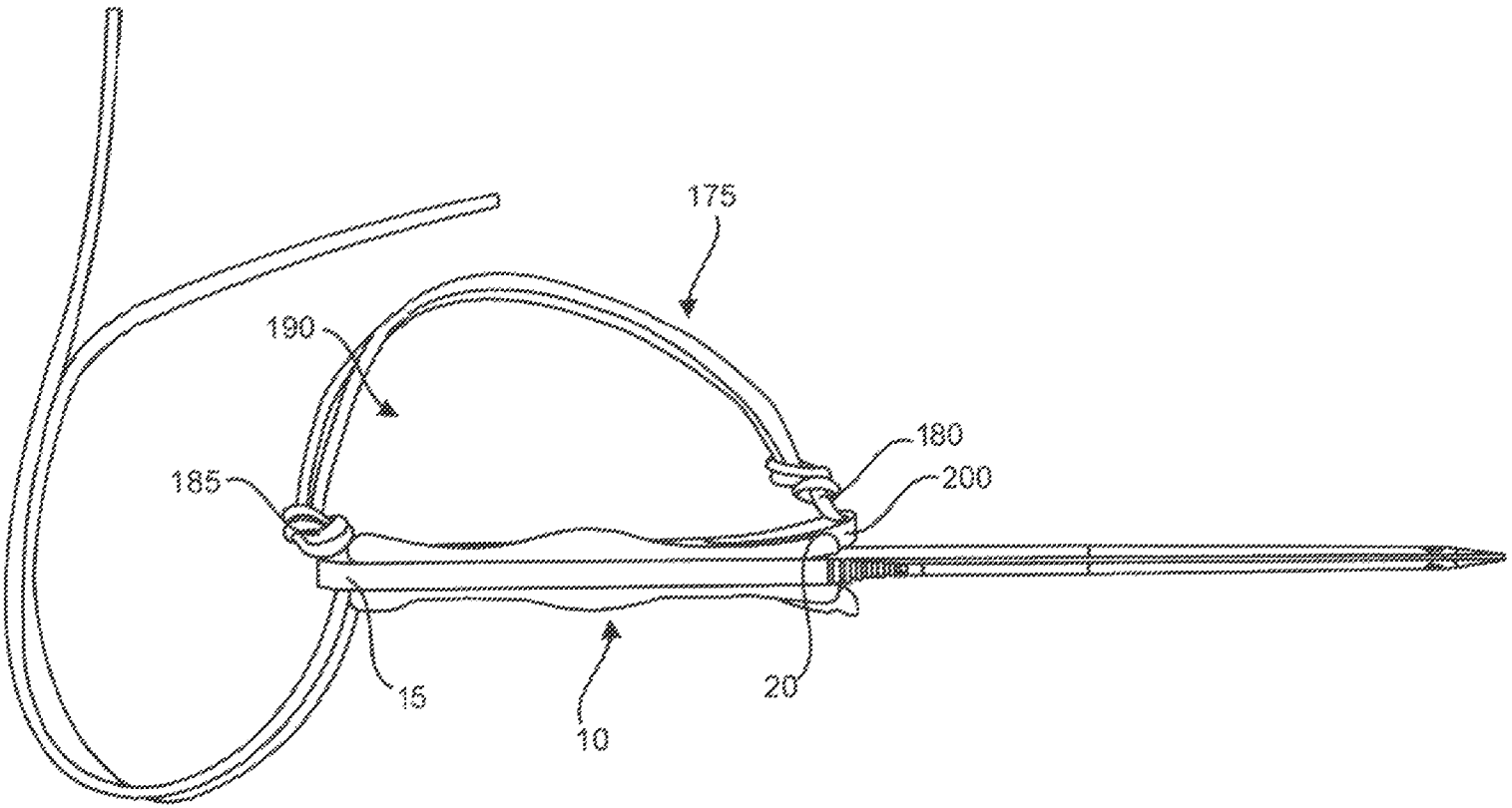
FIG. 8 is a side view of the knife with the attached safety lanyard.
Figure 9:
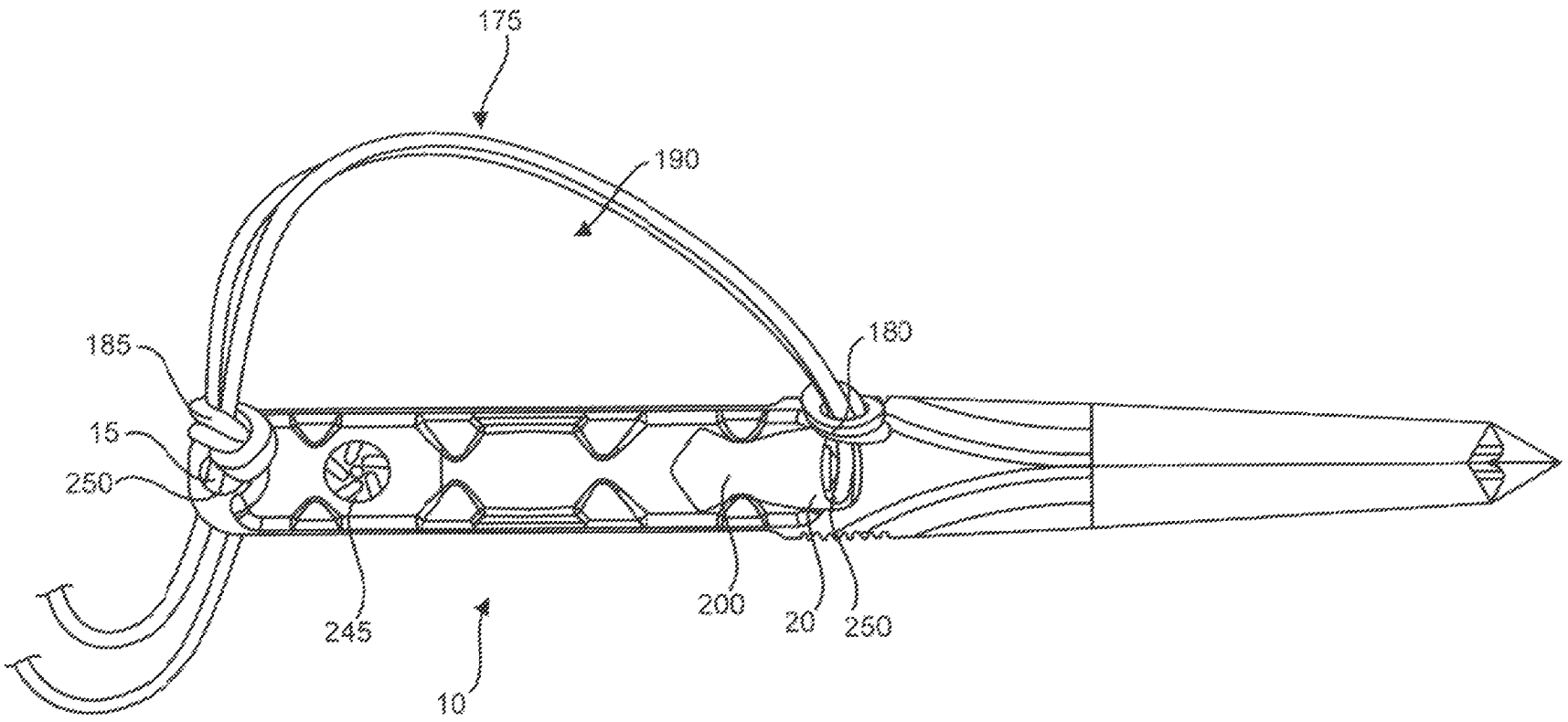
FIG. 9 is a top view of the knife with the attached safety lanyard.

Turning to FIGS. 8-9, the lanyard 175 is shown attached to the handle portion 10 of the knife 5. The lanyard 175 can come in a variety of shapes and sizes; however, at a minimum, it must be operable to attach to the handle portion 10 at two attachment points along the handle portion 10 such that an enclosed loop 190 is formed between the lanyard 175 and the handle portion 10. The lanyard 175 includes a first end 180 and a second 185 end, with the first end 180 being attached to the distal end 20 of the handle 10 and the second end 185 being attached to the proximal end 15 of the handle. For the embodiments that include the thumb plate 200, the first end 180 may be removably attached to the thumb plate 200. As shown in the figures, the lanyard 175 is made from a flexible material, such as a textile or leather, that is fastened to the handle 10 of the knife 5 through attaching apertures 250 in the handle portion 10 (or thumb plate 200). The dual attachment system of the lanyard 170 and closed-loop configuration not only aids in withdrawing the knife from a sheath, but also stabilizes the user's grip on the knife and further prevents the hand from sliding forward while in use.

For the purposes of promoting an understanding of the principles of the invention, reference has been made to the preferred embodiments illustrated in the drawings, and specific language has been used to describe these embodiments. However, this specific language intends no limitation of the scope of the invention, and the invention should be construed to encompass all embodiments that would normally occur to one of ordinary skill in the art. The particular implementations shown and described herein are illustrative examples of the invention and are not intended to otherwise limit the scope of the invention in any way. For the sake of brevity, conventional aspects of the system (and components of the individual operating components of the system) may not be described in detail. Furthermore, the connecting lines, or connectors shown in the various figures presented are intended to represent exemplary functional relationships and/or physical or logical couplings between the various elements. It should be noted that many alternative or additional functional relationships, physical connections or logical connections may be present in a practical device. Moreover, no item or component is essential to the practice of the invention unless the element is specifically described as "essential" or "critical". Numerous modifications and adaptations will be readily apparent to those skilled in this art without departing from the spirit and scope of the present invention.

What is claimed is:

1. A knife comprising:

a handle;

a blade with a tip at its distal end and attached to the handle at its proximal end, said blade comprising a first top surface, a second top surface, a first bottom surface, and a second bottom surface, each surface having a first side and an opposing second side, wherein the first side of the first top surface and the first side of the second top surface intersect to define a top spine joint, wherein the first side of the first bottom surface and the first side of the second bottom surface intersect to define a bottom spine joint, wherein the second side of the first top surface and the second side of the first bottom surface intersect to define a first cutting edge, and wherein the second side of the second top surface and the second side of the second bottom surface intersect to define a second cutting edge, wherein the spine of the blade is defined as the vertical plane between the top spine joint and the bottom spine joint, wherein each surface of the blade extending from the spine to a respective one of the cutting edges comprises a concave segment, followed by a first angled segment, followed by a flat segment, followed by a second angled segment, said tip comprising a first top surface, a second top surface, a first bottom surface, and a second bottom surface, each having a first side and an opposing second side, wherein the first side of the first top surface of the tip and the first side of the second top surface of the tip intersect to define a second top spine joint, wherein the first side of the first bottom surface of the tip and the first side of the second bottom surface of the tip intersect to define a second bottom spine joint, wherein the second side of the first top surface of the tip and the second side of the first bottom surface of the tip intersect to define a first tip cutting edge, and wherein the second side of the second top surface of the tip and the second side of the second bottom surface of the tip intersect to define a second tip cutting edge, wherein each of the surfaces defining the tip is beveled at a consistent angle from the spine to a respective one of the cutting edges, wherein each of the surfaces of the tip, the second top spine, the second bottom spine, the first tip cutting edge, and the second tip cutting edge converge and terminate at a knife point.

2. The knife of claim 1 comprising a safety lanyard with a first end and a second end, wherein the first end is attached to a proximal end of the handle and the second end is attached to a distal end of the handle, such that a closed loop is formed between the lanyard and the handle.

3. The knife of claim 1 wherein the handle further comprises a thumb plate.

4. The knife of claim 3 wherein the second end of the lanyard is removably attached to the thumb plate.

5. The knife of claim 1 wherein the handle is removably attached to the blade.

6. A knife comprising:

a handle;

a blade with a tip at its distal end and attached to the handle at its proximal end; and a lanyard with a first end and a second end, wherein the first end is attached to a proximal end of the handle and the second end is attached to a distal end of the handle, such that a closed loop is formed between the lanyard and the handle;

wherein the blade comprises a first top surface, a second top surface, a first bottom surface, and a second bottom surface, each surface having a first side and an opposing second side, wherein the first side of the first top surface and the first side of the second top surface intersect to define a top spine joint, wherein the first side of the first bottom surface and the first side of the second bottom surface intersect to define a bottom spine joint, wherein the second side of the first top surface and the second side of the first bottom surface intersect to define a first cutting edge, and wherein the second side of the second top surface and the second side of the second bottom surface intersect to define a second cutting edge, wherein the spine of the blade is defined as the vertical plane between the top spine joint and the bottom spine joint, wherein each surface of the blade extending from the spine to a respective one of the cutting edges comprises a concave segment, followed by a first angled segment, followed by a flat segment, followed by a second angled segment, said tip comprising a first top surface, a second top surface, a first bottom surface, and a second bottom surface, each having a first side and an opposing second side, wherein the first side of the first top surface of the tip and the first side of the second top surface of the tip intersect to define a second top spine joint, wherein the first side of the first bottom surface of the tip and the first side of the second bottom surface of the tip intersect to define a second bottom spine joint, wherein the second side of the first top surface of the tip and the second side of the first bottom surface of the tip intersect to define a first tip cutting edge, and wherein the second side of the second top surface of the tip and the second side of the second bottom surface of the tip intersect to define a second tip cutting edge, wherein each of the surfaces defining the tip is beveled at a consistent angle from the spine to a respective one of the tip cutting edges, wherein each of the surfaces of the tip, the second top spine, the second bottom spine, the first tip cutting edge, and the second tip cutting edge converge and terminate at a knife point.

7. The knife of claim 6 wherein the handle further comprises a thumb plate disposed at the distal end of the handle.

8. The knife of claim 7 wherein the second end of the lanyard is removably attached to the thumb plate.

9. A knife comprising:

a handle with a proximal end and a distal end;

a blade with a tip at its distal end and attached to the handle at its proximal end; and a thumb plate attached to the distal end of the handle;

wherein the blade comprises a first top surface, a second top surface, a first bottom surface, and a second bottom surface, each surface having a first side and an opposing second side, wherein the first side of the first top surface and the first side of the second top surface intersect to define a top spine joint, wherein the first side of the first bottom surface and the first side of the second bottom surface intersect to define a bottom spine joint, wherein the second side of the first top surface and the second side of the first bottom surface intersect to define a first cutting edge, and wherein the second side of the second top surface and the second side of the second bottom surface intersect to define a second cutting edge, wherein the spine of the blade is defined as the vertical plane between the top spine joint and the bottom spine joint, wherein each surface of the blade extending from the spine to a respective one of the cutting edges comprises a concave segment, followed by a first angled segment, followed by a flat segment, followed by a second angled segment, said tip comprising a first top surface, a second top surface, a first bottom surface, and a second bottom surface, each having a first side and an opposing second side, wherein the first side of the first top surface of the tip and the first side of the second top surface of the tip intersect to define a second top spine joint, wherein the first side of the first bottom surface of the tip and the first side of the second bottom surface of the tip intersect to define a second bottom spine joint, wherein the second side of the first top surface of the tip and the second side of the first bottom surface of the tip intersect to define a first tip cutting edge, and wherein the second side of the second top surface of the tip and the second side of the second bottom surface of the tip intersect to define a second tip cutting edge, wherein each of the surfaces defining the tip is beveled at a consistent angle from the spine to a respective one of the tip cutting edges, wherein each of the surfaces of the tip, the second top spine, the second bottom spine, the first tip cutting edge, and the second tip cutting edge converge and terminate at a knife point.

10. The knife of claim 9 further comprising a lanyard with a first end and a second end, wherein the first end is attached to the proximal end of the handle and the second end is attached to the thumb plate, such that a closed loop is formed between the lanyard and the handle.

* * * * *